US006764328B2

(12) United States Patent
Van Dulmen et al.

(10) Patent No.: US 6,764,328 B2
(45) Date of Patent: Jul. 20, 2004

(54) ELECTRIC LAMP AND SHAPED METAL BODY FOR USE THEREIN

(75) Inventors: Hendrikus Albertus Maria Van Dulmen, Eindhoven (NL); Jacques Maria Jozef Geboers, Roosendaal (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 67 days.

(21) Appl. No.: 10/181,081

(22) PCT Filed: Nov. 9, 2001

(86) PCT No.: PCT/EP01/13098

§ 371 (c)(1),
(2), (4) Date: Jul. 12, 2002

(87) PCT Pub. No.: WO02/41350

PCT Pub. Date: May 23, 2002

(65) Prior Publication Data

US 2003/0003806 A1 Jan. 2, 2003

(30) Foreign Application Priority Data

Nov. 17, 2000 (EP) ..... 00204054

(51) Int. Cl.[7] ..... H01R 33/02
(52) U.S. Cl. ..... 439/226; 313/318.01
(58) Field of Search ..... 439/226; 313/318.01, 313/318.02, 318.05, 578, 580

(56) References Cited

U.S. PATENT DOCUMENTS

| | | | | | |
|---|---|---|---|---|---|
| 3,622,832 | A | * | 11/1971 | Schlessel et al. | 313/318.11 |
| 4,100,448 | A | * | 7/1978 | Chipner et al. | 313/318.11 |
| 4,208,603 | A | * | 6/1980 | Graves et al. | 313/1 |
| 4,897,573 | A | * | 1/1990 | Ooms | 313/273 |
| 5,252,888 | A | * | 10/1993 | Topel et al. | 313/318.01 |
| 5,289,079 | A | * | 2/1994 | Wittmann | 313/318.02 |

FOREIGN PATENT DOCUMENTS

| | | |
|---|---|---|
| WO | WO9850942 | 11/1998 |
| WO | WO9850943 | 11/1998 |

* cited by examiner

*Primary Examiner*—Tulsidas C. Patel

(57) ABSTRACT

The electric lamp has a lamp vessel (1) composed of a glass bulb (2) and a glass plate (3) sealing the bulb (2). A shaped metal body (20) is embedded in the glass plate (3). The shaped metal body (20) has a plate-shaped metal member (10) with which a tube (11) is integral and with which current conductors (12) are integral via bridges (15). The glass plate (3) has at least one recess (4) in which a bridge (15) to a current conductor (12) is located, which bridge (15) has a disconnection (16) in the recess (4), thus insulating the relevant current conductor (12) from the metal member (10). The lamp is of a simple construction that can be easily realized. The current conductors (12) occupy a predetermined position with respect to one another in the lamp owing to the use of the shaped metal body (20), and fewer components have to be combined in the manufacture of the lamp.

9 Claims, 3 Drawing Sheets

ELECTRIC LAMP AND SHAPED METAL BODY FOR USE THEREIN

The invention relates to an electric lamp comprising:

a lamp vessel provided with a glass bulb which is sealed off in a vacuumtight manner by a plate comprising glass;

a gas filling in the lamp vessel;

a metal tube embedded in said plate, in open communication with the gas filling and closed outside the lamp vessel;

current conductors embedded in said plate, each provided with a first end portion in the lamp vessel and a second end portion outside the lamp vessel; and an electric element arranged in the lamp vessel and connected to the current conductors.

The invention also relates to a shaped metal body for use in said lamp.

Such an electric lamp is known from WO-98/50942 (PHN 16.355).

The known lamp is an incandescent lamp whose incandescent body occupies an accurate, predetermined position with respect to the plate, and which also has a compact construction. The lamp may have, for example, a dimension from the outer side of the plate to the top of the bulb of less than 2 cm. The lamp is suitable for use as a light source at the rear of a motor vehicle, for example as a brake light, rear light, reversing light, fog rear light, indicator light, etc.

Such a lamp is known from WO-98/50943 (PHN 16.356) and is provided with a lamp cap. The lamp cap securely holds the lamp vessel in that it is clicked around said plate. To counteract rotation of the bulb relative to the lamp cap, the plate may have an unround shape which corresponds to an unround shape of the lamp cap. It is possible, however, to cause the lamp vessel to wobble in the lamp cap if a comparatively great force is exerted.

The known lamp has a gas filling of comparatively high pressure comprising, for example, Kr and/or Xe, and as a result has the advantage of a long useful life, for example of 2000 h, at a high luminous efficacy, for example of 18 Im/W.

The known lamp, however, has the disadvantage that a comparatively large number of metal parts: metal wires as current conductors and the metal tube as an exhaust tube, is necessary, which parts are to be provided in the plate in predetermined positions. This renders the manufacture of the lamp complicated.

It is an object of the invention to provide an electric lamp of the kind described in the opening paragraph which is of a simple construction which can be easily realized.

According to the invention, this object is achieved in that a plate-shaped metal member is embedded in the plate, the metal tube is connected to said metal member, the plate-shaped metal member has metal bridges to the current conductors, the plate has a recess for at least one current conductor, and a bridge is present in said recess between the metal member and said current conductor, which bridge has an interruption in said recess which keeps an electrical contact to the plate-shaped metal member interrupted.

In the manufacture of the lamp, the plate-shaped metal member, the metal tube, and the current conductors form one metal body, so that only one metal part need to be joined together with glass so as to obtain the plate, as opposed to three metal parts in the known lamp, which has two current conductors. This simplifies the logistics of lamp manufacture and makes the construction of the lamp simple. A result of the use of the one metal body is that portions thereof, in particular the current conductors, but also the metal tube, have predetermined positions relative to one another, i.e. those positions in which they are present in said one metal body owing to the manufacture thereof. After the plate with the metal body embedded therein has been manufactured, the bridge to the plate-shaped metal body in the recess is provided with said interruption for at least one current conductor so as to eliminate the short-circuit between the current conductors. This may be readily realized, for example, by means of a laser which is aimed at the bridge in the recess so as to melt the bridge locally. Alternatively, the bridge may be made to melt, for example, through the passage of a current. Rounded, solidified melts are accordingly observable in the recess as remnants of the bridges. The lamp according to the invention is of a simple construction which is also easy to realize.

It is advantageous if the metal tube is integral with the plate-shaped metal member. The metal tube may then be formed from the plate-shaped member by deep-drawing. A fastening operation such as, for example, welding is thus avoided. It is advantageous for the same reason if the current conductors are also integral with the plate-shaped member during lamp operation. They then form one shaped metal body together with the plate-shaped member, and possibly with the metal tube, during the manufacture of the lamp. Said shaped metal body may be readily obtained through stamping and bending, and possibly through deep-drawing, from metal plating. During bending, at least the first end portions of the current conductors are moved transversely to the plate-shaped member. In this embodiment, the current conductors have a substantially rectangular cross-section which has resulted from cutting or stamping from metal plating. The current conductors then obviously consist of the same material as the metal member and in general will have the same thickness as the metal member in those locations where it is not deformed by bending or deep-drawing.

It is attractive when the plate has a recess for each current conductor, in which recess the bridge for the respective current conductor is present, said bridge having an interruption. It is achieved thereby that the metal tube is not live during operation, and the risk of short-circuits caused by metal in the surroundings of the lamp is prevented.

The recesses may extend from inside the lamp onto the bridges in the plate and accordingly be in communication with the gas filling, but it is favorable if the recesses are present at an outer surface of the plate. They may then be in communication with the lamp surroundings. The advantage of this is that the bridges may be given their interruptions after the lamp vessel has been sealed. This avoids the risk of the lamp interior becoming polluted by vapors evolved during making of the interruptions. Alternatively, the recesses may be channels which pass through the plate, i.e. in the case in which the recesses are located laterally of the bulb and the gastightness of the lamp vessel is accordingly maintained in spite of the channels.

It is advantageous if the plate has a second recess for each current conductor, in which second recess a second bridge with a respective interruption is present. The shaped metal body then has a high permanence of shape and offers an additional security that deformation is avoided when it is being manipulated, for example during the manufacture of the plate of the lamp vessel.

The plate of the lamp vessel may be manufactured in that the shaped metal body is embedded in molten glass, and the latter is pressed into its final shape by means of a mold. Alternatively, the plate may be formed in a mold containing the shaped metal body and glass powder, which is subsequently sintered.

The construction of the lamp according to the invention is particularly suitable if the lamp comprises more than one electric element, for example two electric elements. An additional current conductor necessary for an additional electric element for operating the latter independently of the first can be readily realized in an analogous manner. An additional current conductor, however, may also be present in a lamp having only one electric element. This has the advantage that the same shaped metal body may be used in a lamp family comprising lamps with one and lamps with two electric elements.

The electric element may be an incandescent body, in which case the gas filling may comprise a halogen or a halogen compound. The electric element may alternatively be a pair of electrodes, in which case the gas filling is ionizable.

The second end portions of the current conductors may extend in various directions, for example transversely to the plate or substantially parallel to the plate, for example in the plane of the plate. The second end portions may be readily dimensioned so as to serve as contact pins or contact strips for a holder or for a printed circuit and to support the lamp. The second end portions may also be given barbed hooks, for example immediately during their creation, in which case they may serve to provide an indetachable coupling to a lamp cap in that they are inserted into a slot in such a lamp cap. Unround shapes of the plate and of a lamp cap are generally not necessary in the lamp according to the invention, other than in the known lamp, for achieving a non-rotatable coupling to a lamp cap or lampholder because the current conductors may be easily dimensioned so as to have a sufficient stiffness for this coupling.

In a special embodiment, tongues having barbed hooks are present at the plate-shaped member, which tongues extend along the metal tube to outside the lamp vessel. In this embodiment, the tongues are suitable for coupling the lamp, for example to a lamp cap, which mechanical coupling will be separate from the electrical contacting.

The lamp vessel may consist of lead-free glass such as, for example, from $SiO_2$ 60–72; $Al_2O_3$ 1–5; $Li_2O$ 0.5–1.5; $Na_2O$ 5–9; $K_2O$ 3–7; MgO 1–2; CaO 1–3; SrO 1–5; BaO 7–11, rest <0.5% by weight. The bulb of the lamp vessel may be, for example, spherical or spherical with a, for example, cylindrical neck. The bulb may have a diffusely reflecting coating, for example a white coating, for example made of $TiO_2$ or $ZrO_2$, adjacent the plate. Alternatively, the bulb may have a metal coating, for example of aluminum, or a dichroic mirror in said location. Furthermore, a water vapor getter, for example ZrAl or ZrPd, may be present in the bulb, for example on a current conductor. The bulb may be connected to the plate by means of, for example, enamel or a solidified glass melt.

The plate-shaped member, the current conductors, and the metal tube may be made, for example, from a nickel-iron-chromium alloy or molybdenum.

The gas filling may comprise, for example, Kr or Xe or a mixture thereof, or Ar, for example with a pressure of more than 1 bar, for example 2 to 15, in particular 2 to 8, for example 3 to 5 bar.

The lamp according to the invention is readily realized through the use of a shaped metal body characterized by a plate-shaped metal member with which a tube open at two sides is integral and with which current conductors are integral, which current conductors are connected to the plate-shaped member via bridges, said current conductors each having a first end portion which extends transversely to the plate-shaped member in a direction away from the tube and a second end portion extending away from the plate-shaped member.

In a special embodiment, tongues are present at the plate-shaped member, which tongues extend alongside the tube and have barbed hooks.

An embodiment of the electric lamp according to the invention and of the shaped metal body for the lamp is shown in the drawings, in which FIG. 1 is a side elevation of the electric lamp;

Figure 1:
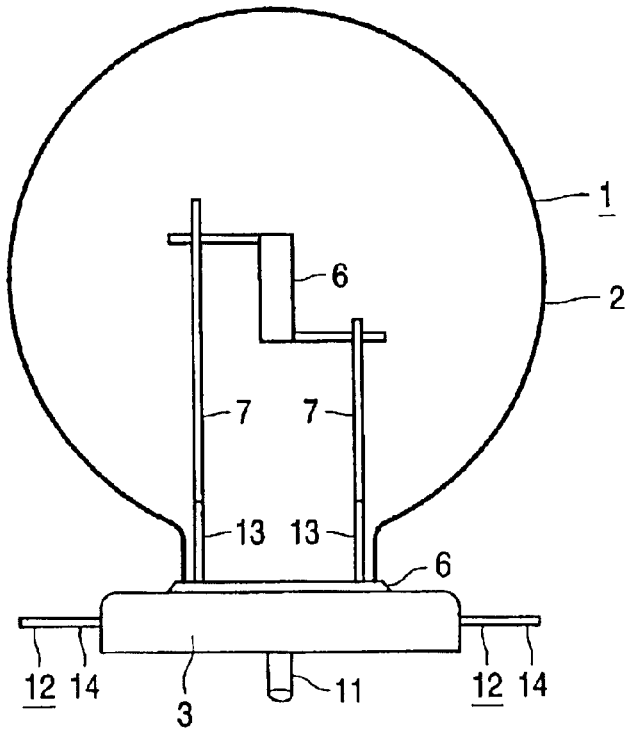

In FIG. 1, the electric lamp has a lamp vessel 1 provided with a glass bulb 2 which is sealed off by a plate 3 comprising glass by means of enamel 6 in a vacuumtight manner. The plate 3 in the embodiment shown is made of sintered glass of the same composition as the glass of the bulb 2. A gas filling is present in the lamp vessel 1, consisting of 5 bar of krypton in the lamp shown. A metal tube 11 is embedded in the plate 3, is in open communication with the gas filling and is closed outside the lamp vessel, by means of a solidified drop of the tube 11 itself in the Figure. Alternatively, for example, a drop of tungsten may be added for closing the tube 11. Current conductors 12 are embedded in the plate 3, each provided with a first end portion 13 inside the lamp vessel 1 and a second end portion 14 outside the lamp vessel 1. An electric element 6, an incandescent body in the Figure, is arranged in the lamp vessel 1 and connected to the current conductors 12, in FIG. 1 by means of molybdenum wires 7. The bulb 2 is made of a glass having a composition: $SiO_2$ 67.59; $Al_2O_3$ 3.56; $LiO_2$ 1.27; $Na_2O$ 7.38; $K_2O$ 4.88; MgO 1.24; CaO 1.89; SrO 3.04; BaO 8.81; $CeO_2$ 0.12; $SO_3$ 0.17; rest 0.05% by weight.

Figure 2:
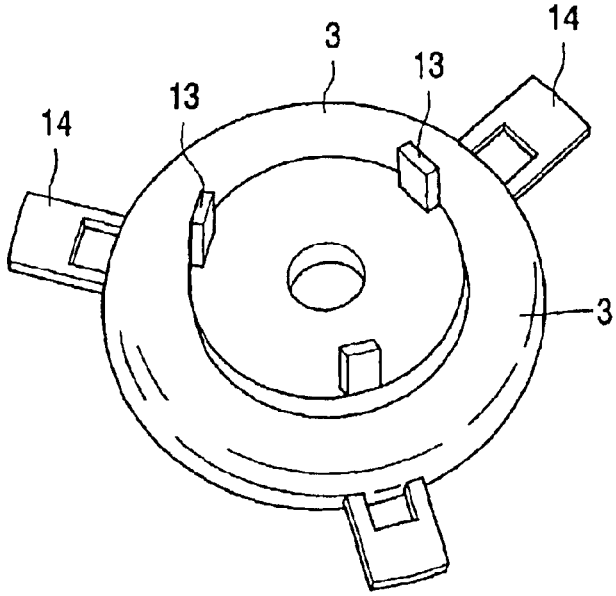
FIG. 2 is an interior perspective view of a modification of the plate of the lamp of FIG. 1.
Figure 3:
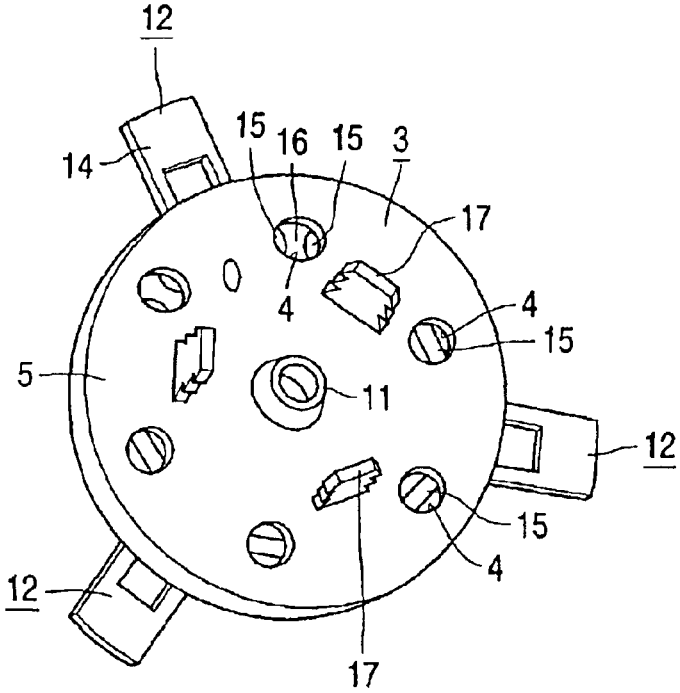
FIG. 3 is an exterior perspective view of the plate of FIG. 2.
Figure 4:
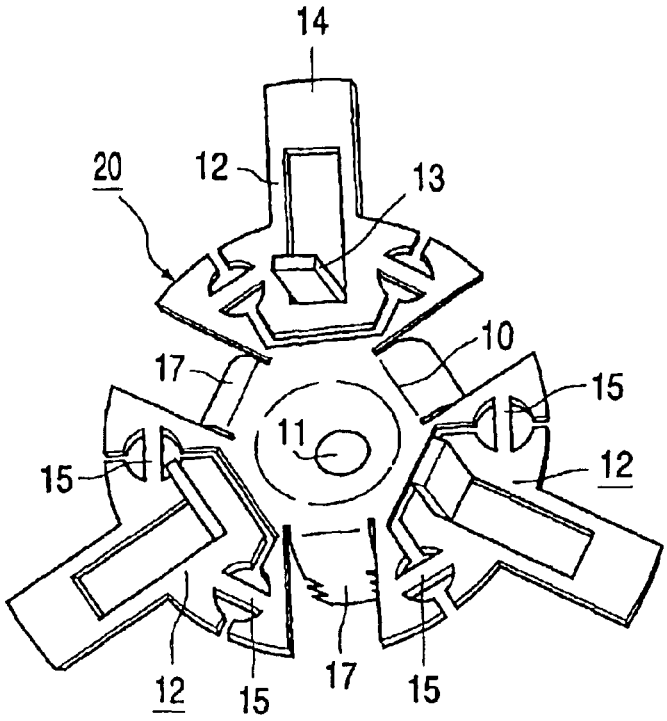
FIG. 4 is an interior perspective view of the shaped metal body of the plate of FIGS. 3 and 4.
Figure 5:
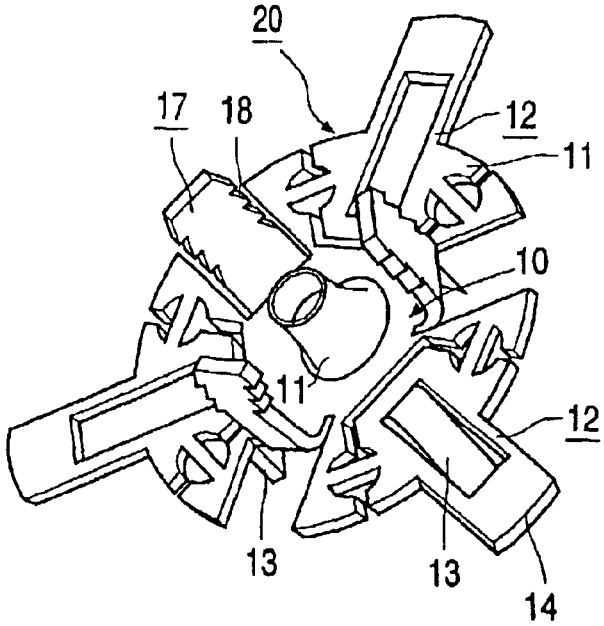
FIG. 5 is an exterior perspective view of the shaped metal body of FIG. 4.

A plate-shaped metal member 10, cf. FIGS. 4 and 5, made of a nickel-iron-chromium alloy in the drawings, is embedded in the plate 3, cf. FIGS. 2 and 3. The metal tube 11 is connected to the metal member 10. The plate-shaped member 10 has metal bridges 15 to the current conductors 12. The plate 3, see FIG. 3, has a recess 4 for at least one current conductor 12, in which recess a bridge 15 is present between the metal member 10 and said current conductor 12, which bridge 15 has an interruption 16 in the recess 4 which keeps the electrical contact to the plate-shaped metal member 10 interrupted, see FIG. 3.

The metal tube 11 in the embodiment shown is integral with the plate-shaped metal member 10, see FIGS. 4 and 5.

The current conductors 12 without the interruption 16 of FIG. 3 are integral with the plate-shaped metal member 10, see FIGS. 4 and 5.

The plate 3 has a recess 4, in which a bridge 15 is present, for each of the current conductors 12. Interruptions 16 for the second current conductor 12 are yet to be made in FIG. 3, if so desired. Preferably, the interruptions are provided after the lamp vessel 1 has been sealed. This is possible because the recesses 4 are present at an outer surface 5 of the plate 3.

The plate 3 of FIG. 1, see also FIG. 3, has a second recess 4 for each current conductor 12, in which second recess a second bridge 15 is present with an interruption 16.

Tongues 17 are present at the plate-shaped member 10, see FIG. 3, which tongues extend to outside the lamp vessel 1 alongside the tube 11 and which tongues have barbed hooks 18. The plate-shaped member 10 of FIGS. 3 to 5 differs from that of FIG. 1 only in that it has these tongues 17 and in that it has bridges 15 to three current conductors 12, as opposed to only two current conductors in FIG. 1.

The shaped metal body 20 for use in the electric lamp according to the invention shown in FIGS. 4 and 5 has a plate-shaped metal member 10 with which a tube 11 open at two sides is integral and with which current conductors 12 are integral. The current conductors 12 are connected to the plate-shaped member 10 via bridges 15. The current conductors 12 each have a first end portion 13 which extends transversely to the plate-shaped member 10 in a direction away from the tube 11 and a second end portion 14 which extends away from the plate-shaped member 10. In these Figures, the shaped metal body also has tongues 17 which extend alongside the tube 11 and which are provided with barbed hooks 18. It is clearly visible in FIG. 4 that the bridges 15 are the only interconnections between the current conductors 12 and the plate-shaped metal member 10. If the bridges 15 connected to the live current conductors 12 are interrupted, the plate-shaped member 10 will be without tension during operation, and so will be the tube 11 projecting outside the lamp vessel 1, see FIG. 1.

Combinations of features of the lamp according to the invention other than those defined in the following claims are equally possible.

What is claimed is:

1. An electric lamp comprising:

a lamp vessel (1) provided with a glass bulb (2) which is sealed off in a vaccuumtight manner by a plate (3) comprising glass;

a gas filling in the lamp vessel (1);

a metal tube (11) embedded in said plate (3), in open communication with the gas filling and closed outside the lamp vessel (1);

current conductors (12) embedded in said plate (3), each provided with a first end portion (13) in the lamp vessel (1) and a second end portion (14) outside the lamp vessel (1); and an electric element (6) arranged in the lamp vessel (1) and connected to the current conductors (12);

wherein, a plate-shaped metal member (10) is embedded in the plate (3), the metal tube (11) is connected to said plate-shaped metal member (10), said plate-shaped metal member (10) has metal bridges (15) to the current conductors (12), the plate (3) has a recess (4) for at least one current conductor (12), and at least one of said bridges (15) is present in said recess (4) between the plate-shaped metal member (10) and said at least one current conductor (12), the at least one of said bridges (15) having an interruption (16) in said recess (4) which keeps an electrical contact to the plate-shaped metal member (10) interrupted.

2. An electric lamp as claimed in claim 1, characterized in that the metal tube (11) is integral with the plate-shaped metal member (10).

3. An electric lamp as claimed in claim 1, characterized in that the current conductors (12) and at least a second one of said bridges is without the interruptions (16) and integral with the plate-shaped metal member (10).

4. An electric lamp as claimed in claim 1, characterized in that the plate (3) has two or more recesses (4), each of said two or more recesses (4) having a one of said current conductors (12), in at least one of said recesses (4) a one of said bridges (15) being present, the one of said bridges (15) having an interruption (16).

5. An electric lamp as claimed in claim 4, characterized in that the recesses (4) are present at an outer surface (5) of the plate (3).

6. An electric lamp as claimed in claim 4, characterized in that the plate (3) has a second recess (4) for each current conductor (12), in which second recess (4) a one of said bridges (15) with an interruption (16) is present.

7. An electric lamp as claimed in claim 1, characterized in that tongues (17) having barbed hooks (18) are present at the plate-shaped member (10), which tongues (17) extend alongside the tube (11) to outside the lamp vessel (1).

8. A shaped metal body for use in the electric lamp as claimed in claim 1, characterized by the plate-shaped metal member (10) being integral with a tube (11) open at two sides and the plate-shaped metal member (10) being integral with one or more of the current conductors (12), said one or more of the current conductors (12) being connected to the plate-shaped member (10) via one or more of the bridges (15), said one or more of the current conductors (12) each having a first end portion (13) which extends transversely to the plate-shaped member (10) in a direction away from the tube (11) and a second end portion (14) which extends away from the plate-shaped member (10).

9. A shaped metal body as claimed in claim 8, characterized in that tongues (17) having barbed hooks (18) are present at the plate-shaped member (10), which tongues (17) extend alongside the tube (11).

* * * * *